US012098845B2

(12) United States Patent
Wang et al.

(10) Patent No.: US 12,098,845 B2
(45) Date of Patent: Sep. 24, 2024

(54) SUPERCRITICAL HYDROTHERMAL COMBUSTION DEVICE

(71) Applicant: Xi'an Jiaotong University, Xi'an (CN)

(72) Inventors: Shuzhong Wang, Xi'an (CN); Yanhui Li, Xi'an (CN); Zicheng Li, Xi'an (CN); Wenqing He, Xi'an (CN); Chengchao Cui, Xi'an (CN); Jie Zhang, Xi'an (CN); Zhuohang Jiang, Xi'an (CN)

( * ) Notice: Subject to any disclaimer, the term of this patent is extended or adjusted under 35 U.S.C. 154(b) by 65 days.

(21) Appl. No.: 17/815,165

(22) Filed: Jul. 26, 2022

(65) Prior Publication Data

US 2023/0068390 A1 Mar. 2, 2023

(30) Foreign Application Priority Data

Aug. 31, 2021 (CN) ..... 202111011198.X
Aug. 31, 2021 (CN) ..... 202111011233.8

(51) Int. Cl.

| | |
|---|---|
| ***F23D 14/78*** | (2006.01) |
| ***F22B 1/18*** | (2006.01) |
| ***F22B 3/08*** | (2006.01) |
| ***F23D 14/58*** | (2006.01) |

(52) U.S. Cl.

CPC ..... *F23D 14/78* (2013.01); *F22B 1/1807* (2013.01); *F22B 3/08* (2013.01); *F23D 14/58* (2013.01); *F23D 2207/00* (2013.01); *F23D 2214/00* (2013.01)

(58) Field of Classification Search

CPC ..... F23D 14/78; F23D 14/58; F22B 1/1807; E21B 36/02

USPC ..... 431/350, 353, 354, 183, 157–158, 258, 431/263

See application file for complete search history.

(56) References Cited

FOREIGN PATENT DOCUMENTS

CN 110617466 A * 12/2019

* cited by examiner

*Primary Examiner* — Vivek K Shirsat
(74) *Attorney, Agent, or Firm* — Novoclaims Patent Services LLC; Mei Lin Wong

(57) ABSTRACT

A supercritical hydrothermal combustion device comprises a main enclosure and a top cap. A partition is mounted in the main enclosure and divides the interior of the main enclosure into a main combustion space and a mixing space. The top cap is provided with a primary fuel inlet, an oxidant inlet and a secondary fuel inlet. A high-temperature ignition bar sleeve, having a high-temperature ignition bar arranged therein, is disposed in the top cap. A combustion sleeve, having a stable combustion space formed therein, is mounted at a bottom of the top cap, and has a top communicated with the high-temperature ignition bar sleeve and the oxidant inlet, as well as a bottom communicated with the main combustion space. The secondary fuel inlet and a secondary oxidant inlet are communicated with the main combustion space. Supercritical hydrothermal combustion is realized to generate a hybrid thermal fluid or treat organic wastes.

20 Claims, 6 Drawing Sheets

SUPERCRITICAL HYDROTHERMAL COMBUSTION DEVICE

CROSS REFERENCE OF RELATED APPLICATION

This is a non-provisional application that claims priority to a Chinese application, Chinese application number CN202111011198.X, filed Aug. 31, 2021, and Chinese application number CN202111011233.8, filed Aug. 31, 2021, the entire contents of each of which are expressly incorporated herein by reference.

BACKGROUND OF THE PRESENT INVENTION

Field of Invention

The invention belongs to the technical field of supercritical hydrothermal combustion, and particularly relates to a supercritical hydrothermal combustion device.

Description of Related Arts

With the development of supercritical water oxidation, the problems of corrosion and blockage caused by salt-deposition become increasingly significant. Supercritical hydrothermal combustion is a new combustion technology for generating hydrothermal flames by means of intense oxidization reaction between organic matter with a certain concentration and oxidants in supercritical water. The hydrothermal flame, as an internal heat source, allows materials to enter a reactor at room temperature, so the materials will not be preheated to a supercritical state in a preheater or at an inlet of the reactor, avoiding the blockage caused by precipitation of inorganic salts and reducing corrosion to pipelines and the reactor. Due to the presence of the hydrothermal flame, the reaction temperature (>700° C.) of supercritical hydrothermal combustion is higher than the reaction temperature (400-600° C.) of supercritical water oxidization, allowing the reaction to be completed within milliseconds and increasing the degradation rate of organic matter to 99.9%. The supercritical hydrothermal combustion technology, as a green, clean and efficient organic waste treatment technology and energy exploitation technology, has broad market prospects, and the study of the supercritical hydrothermal combustion technology is of great significance.

Moreover, thermal recovery technologies used at present for producing heavy oil in oilfields such as steam huff and puff, steam flooding and steam-assisted gravity drainage, inject steam, used as a heat carrier, into the stratum to heat heavy oil to reduce the viscosity and improve the liquidity of the heavy oil, so as to facilitate heavy oil recovery. Because the steam injection boiler is located on the ground, severe heat losses will be generated in the production process of heavy oil, and among them, the fuel gas loss of the steam injection boiler on the ground is about 20%, the heat loss of steam pipelines on the ground is about 15%, the heat loss of an underground mineshaft is about 10%, and the total heat loss may reach 50%. In addition, the steam injection boiler on the ground and the steam pipelines occupy a large area, while the space of an offshore oil exploitation platform is limited, so the application of offshore heavy oil thermal recovery technologies is limited.

Most existing supercritical hydrothermal reactors adopt thermal spontaneous ignition, and in the ignition process, fuels and oxidants are heated to high temperature before entering the reactor, which increases the probability of ignition failure caused by blockage of the reactor due to precipitation of inorganic salts in the fuels at the inlet of the reactor. So, how to stably produce and maintain a hydrothermal flame is a core problem of supercritical hydrothermal combustion.

SUMMARY OF THE PRESENT INVENTION

To overcome the defects of the aforementioned existing technologies, the objective of the invention is to provide a supercritical hydrothermal combustion device, which can stably and safely produce supercritical hydrothermal flames to carry out hydrothermal reaction between organic matter and oxidants efficiently and stably and can further overcome the defects of great heat loss and large occupied area of traditional steam injection boilers.

To fulfill the above objective, the technical solution adopted by the invention is as follows:

A supercritical hydrothermal combustion device comprises a main shell, a top cap being mounted at a top of the main shell, wherein:

A partition is mounted in the main enclosure and divides an interior of the main enclosure into an upper main combustion space A2 and a lower mixing space A3, a hole is formed in the partition, a mixing water inlet is formed in an upper portion of the mixing space A3, and a combustion product nozzle is disposed at a bottom of the mixing space A3;

The top cap is provided with a primary fuel inlet, an oxidant inlet and a secondary fuel inlet, a high-temperature ignition bar sleeve is disposed in the top cap, a high-temperature ignition bar is disposed in the high-temperature ignition bar sleeve, and the primary fuel inlet is communicated with an interior of the high-temperature ignition bar sleeve;

A combustion sleeve is mounted at a bottom of the top cap, a high-temperature end of the high-temperature ignition bar stretches into the combustion sleeve, the combustion sleeve has a top communicated with the high-temperature ignition bar sleeve and the oxidant inlet, as well as a bottom communicated with the main combustion space A2, and a stable combustion space A1 is formed in the combustion sleeve;

The secondary fuel inlet is directly communicated with the main combustion space A2.

In one embodiment, an oxidant channel is disposed on an outer wall of the high-temperature ignition bar sleeve in a circumferential direction, and the oxidant inlet is communicated with the stable combustion space A1 through the oxidant channel.

In one embodiment, the oxidant inlet comprises a primary oxidant inlet and a secondary oxidant inlet, the primary oxidant inlet is communicated with the oxidant channel, and the secondary oxidant inlet is directly communicated with the main combustion space A2.

In one embodiment, a flow rate of the primary fuel inlet is far smaller than that of the secondary fuel inlet.

In one embodiment, a portion, located in the stable combustion space A1, of the high-temperature ignition bar is at high temperature to realize forced ignition of a primary fuel and oxidant in the stable combustion space A1, and the stable combustion space A1 is inserted into an upper portion of the main combustion space A2, so that a high-temperature combustion product and non-combusted high-temperature oxidant in the stable combustion space A1 are rapidly injected into the main combustion space A2 to be turbulently mixed with a secondary fuel under a large flow rate and a cold state to induce intense heat transfer rapidly heat the secondary fuel to spontaneous ignition temperature, thermal spontaneous ignition of material in the cold state, and a stable hydrothermal flame is generated.

In one embodiment, a primary fuel nozzle is mounted at a bottom of the high-temperature ignition bar sleeve and is communicated with an annular space formed between the high-temperature ignition bar and the high-temperature ignition bar sleeve, and a primary fuel enters the primary fuel nozzle along the annular space formed between the high-temperature ignition bar and the high-temperature ignition bar sleeve and is sprayed into the stable combustion space A1.

In one embodiment, the primary fuel nozzle is a replaceable nozzle, and is coaxial with the high-temperature ignition bar to form an annular gap, small slant holes are formed in the primary fuel nozzle in a circumferential direction, and the primary fuel is sprayed into the stable combustion space A1 obliquely and vertically to be mixed with an oxidant.

In one embodiment, a vortex wall is mounted in the combustion sleeve, a vortex wall cooling water channel is formed between an outer surface of the vortex wall and an inner wall of the combustion sleeve, a vortex wall cooling water inlet of the vortex wall cooling water channel is located in the top cap, and a vortex wall cooling water outlet of the vortex wall cooling water channel faces the main combustion space A2, so that heated cooling water is spirally sprayed into the main combustion space A2 and is mixed with and transfers heat to a secondary fuel.

In one embodiment, the high-temperature ignition bar, the high-temperature ignition bar sleeve, the primary fuel nozzle, the vortex wall and the combustion sleeve are assembled coaxially and penetrate through the top cap.

In one embodiment, a main enclosure water-cooled wall is mounted in the main enclosure corresponding to the main combustion space A2, a cooling water channel is formed between an outer surface of the main enclosure water-cooled wall and an inner wall of the main enclosure, a main enclosure water-cooled wall inlet of the cooling water channel is located in the top cap, and a main enclosure water-cooled wall outlet is located below the main enclosure.

In one embodiment, the main enclosure water-cooled wall is disposed on an upper portion of the inner wall of the main enclosure, a transpiring wall is disposed on a lower portion of the inner wall of the main enclosure, and a transpiring wall space A4 is formed between the transpiring wall and the main enclosure; and wall cooling water enters the cooling water channel between the main enclosure water-cooled wall and the main enclosure via the main enclosure water-cooled wall inlet and absorbs combustion heat in the main combustion space A2; and then, the wall cooling water flows into the transpiring space A4 in an axial direction and forms a liquid membrane on a surface of the transpiring wall to be mixed with a hybrid thermal fluid.

In one embodiment, the liquid membrane is mixed with the hybrid thermal fluid to directly obtain a product which is then discharged.

In one embodiment, the transpiring wall is composed of a porous pipe, and is engaged and connected with the main enclosure water-cooled wall in the axial direction.

In one embodiment, a bottom edge of the transpiring wall is engaged and connected with a top edge of the partition.

In one embodiment, a bottom of the partition is shaped like an inverted cone to form a necking structure, an outlet nozzle is disposed at a center of the partition, multiple small slant holes, acting as outlets, are formed in a conical surface, and a cross-section of an inlet end of the combustion product nozzle is smaller than that of the mixing space A3, and an outlet end of the combustion product nozzle is provided with small holes acting as outlets, and a nozzle, so that dual pressure control is realized.

In one embodiment, a mixing channel is disposed on an outer wall of the partition, and the mixing water inlet is communicated with the mixing channel.

In one embodiment, a pressure auto-regulation device is disposed in the main enclosure and is located at the inlet end of the combustion product nozzle, the pressure auto-regulation device comprises a pressure regulation plate provided with a first hole and a pressure regulation device base plate provided with a second hole, the pressure regulation plate and the pressure regulation device base plate are mounted on an inner wall of the main enclosure, the pressure regulation plate is located above the pressure regulation device base plate, a pressure regulation device shell is mounted on the pressure regulation device base plate, a pressure regulation rod capable of moving in an axial direction is mounted in the pressure regulation device shell through axial pressure regulation springs, and the pressure regulation rod stretches upward out of the pressure regulation device shell and is opposite to the first hole.

In one embodiment, the pressure regulation rod is of an inverted-T structure, upper surfaces of two arms of the pressure regulation rod are connected to a lower surface of a top wall of the pressure regulation device shell through the pressure regulation springs, and an intermediate rod stretches upward out of the pressure regulation device shell and is opposite to the first hole.

In one embodiment, a plurality of pressure guide holes are formed in a top surface of the pressure regulation device shell and are communicated with an interior of the pressure regulation device shell.

In one embodiment, a front end of the pressure regulation rod is shaped like a cone, and the first hole matches the cone in shape.

In one embodiment, the oxidant channel, the cooling water channel and the mixing channel are all spiral channels.

Compared with the Prior Art, the Invention has the Following Beneficial Effects:

1. Stable ignition of cold materials and flame maintaining: fuels are fed into the device stage by stage, a primary fuel at a small flow rate flows into the stable combustion space A1 obliquely and vertically via the primary fuel nozzle to be rapidly ignited by the high-temperature front end of the high-temperature ignition bar, so that the interior of the stable combustion space A1 is maintained at high temperature, ensuring stable combustion of a hydrothermal flame, and realizing forced ignition and stable combustion of materials fed under a small flow rate and a cold state.
2. Thermal spontaneous combustion of secondary fuel: the stable combustion space A1 is inserted into the main combustion space A2 by a certain length, and a high-temperature combustion product and non-combusted high-temperature oxidant are rapidly sprayed into the main combustion space A2 to be turbulently mixed with a secondary fuel and secondary oxidant under a large flow rate and a cold state to induce intense heat transfer, so that the secondary fuel and secondary oxidant are quickly heated to spontaneous ignition temperature, thermal spontaneous ignition of the materials under a large flow rate and a cold state is realized, and a stable hydrothermal flame is generated.

3. Good cooling effect of the wall surface of the device: low-temperature water flows through the vortex wall, the main enclosure water-cooled wall and the partition and absorbs heat generated by combustion, so that the wall surface of the device is prevented from being overheated, ensuring the safety and reliability of the device; in addition, after being heated, the low-temperature water flowing through the vortex wall and the partition are mixed with a secondary fuel or a combustion product, so that energy is recovered, and energy resources are saved.
4. Multiple pressure control structures in the device: a necking structure is formed at the bottom of the partition, and a combustion product is sprayed into the mixing space A3 via a small-diameter outlet nozzle and multiple small slant holes acting as outlets; and after being mixed in the mixing space A3, the combustion product is sprayed out via a small-diameter combustion product nozzle.
5. Wall surface cooling effect and good salt-deposition-caused blockage and corrosion preventing effect of the device: low-temperature water flows through the vortex wall and absorbs heat generated by combustion in the stable combustion space A1, so that the surface of the vortex wall is prevented from being overheated; wall cooling water flows into a spiral space between the water-cooled wall and the main enclosure and absorbs heat in the main combustion space A2, so that the wall surface is prevented from being overheated; and then, the wall cooling water flows in the axial direction into the transpiring wall space A4, forms a liquid membrane on the surface of the transpiring wall and is mixed with a hybrid thermal fluid in the mixing space A3, so that salt-deposition-caused blockage and corrosion are prevented.
6. Good adaptability of fuels and low operating cost: a generator can avoid salt deposition and corrosion, and in addition to common fuels such as diesel and methanol, oily wastewater in oilfields can be directly combusted to be used as primary and secondary fuels, thus reducing the operating cost of the generator.
7. The pressure auto-regulation device is disposed in the device, so that auto-regulation of the pressure of products can be realized through a mechanical structure without extra energy such as electricity: a hybrid thermal fluid is throttled to a small target pressure through a gap between the pressure regulation plate and the pressure regulation rod; a small part of the throttled hybrid thermal fluid flows into the pressure guide holes in the pressure regulation device shell and is counterbalanced with the reactive force of the pressure regulation springs; when the pressure of the hybrid thermal fluid increases, the hybrid thermal fluid pushes the pressure regulation rod to move towards the pressure regulation plate, the gap between the pressure regulation rod and the pressure regulation plate becomes smaller, the fluid resistance increases, and the hybrid thermal fluid restores to a target pressure; when the pressure of the hybrid thermal fluid becomes lower by throttling, the process is opposite to the above process, the fluid resistance decreases, and the hybrid thermal fluid restores to the target pressure.

DETAILED DESCRIPTION OF THE PREFERRED EMBODIMENT

Figure 1:
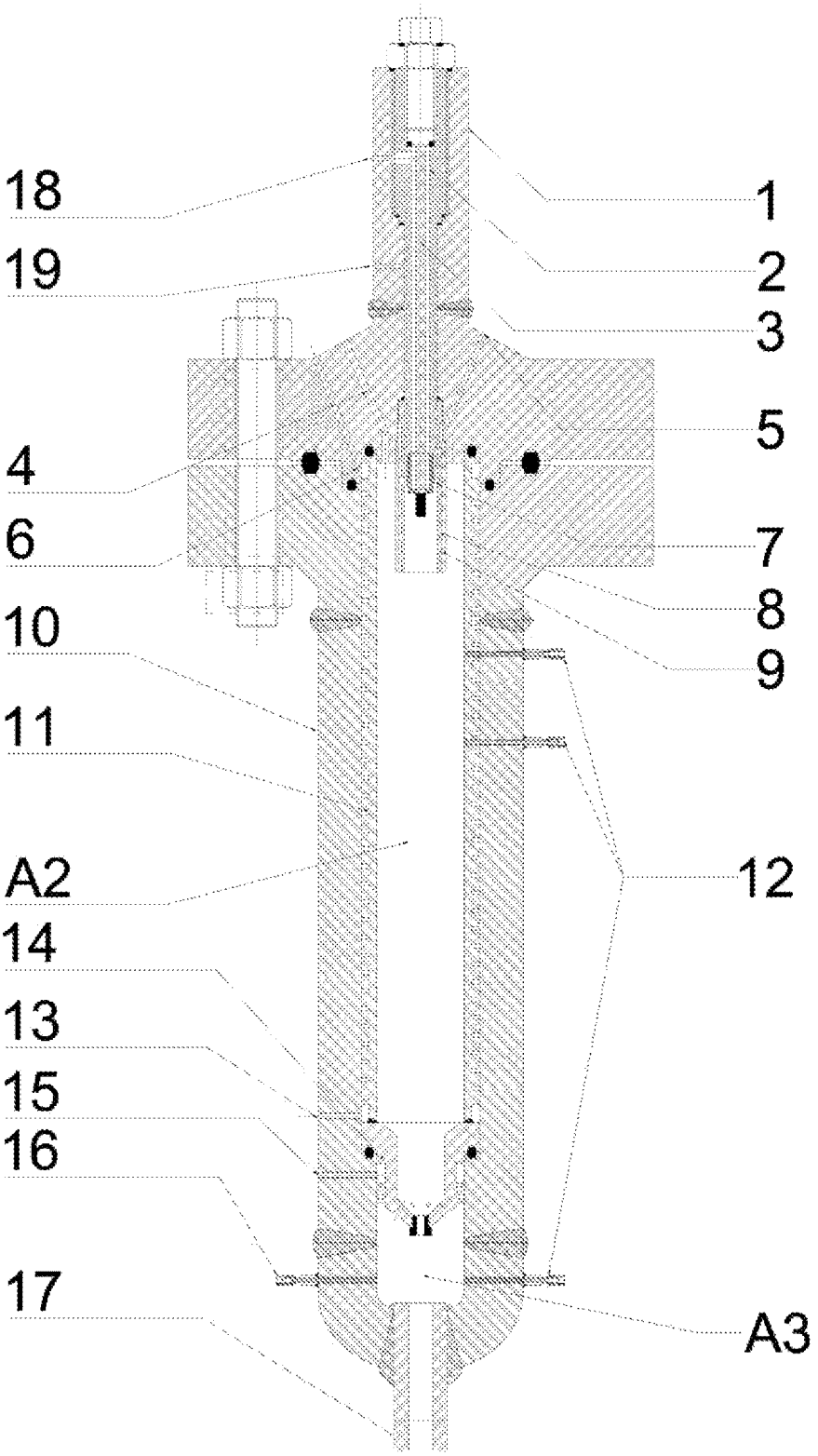
FIG. 1 is a structural view of Embodiment 1 of the invention.
Figure 2:
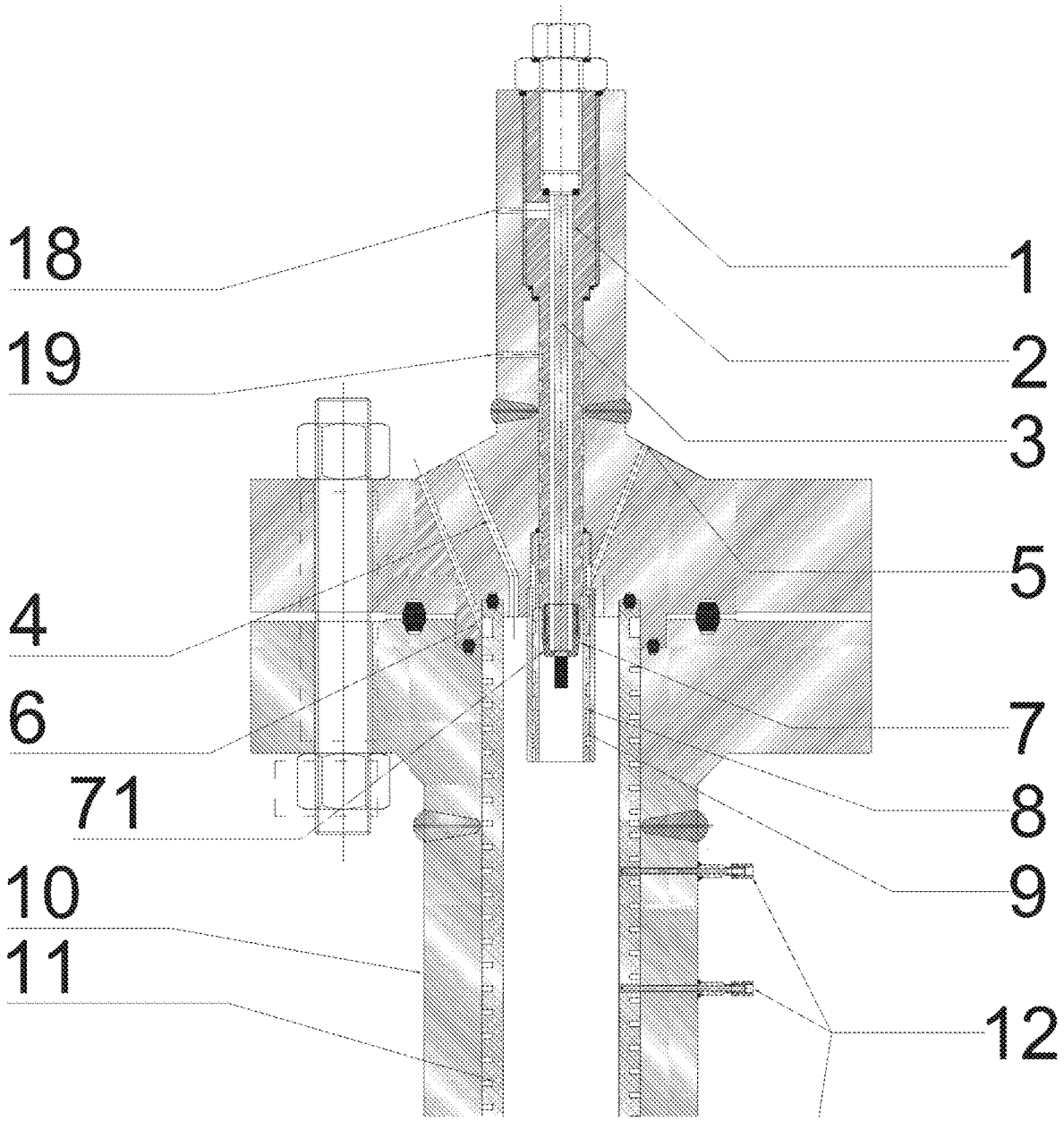
FIG. 2 is a partial (upper) enlarged view of Embodiment 1 of the invention.
Figure 3:
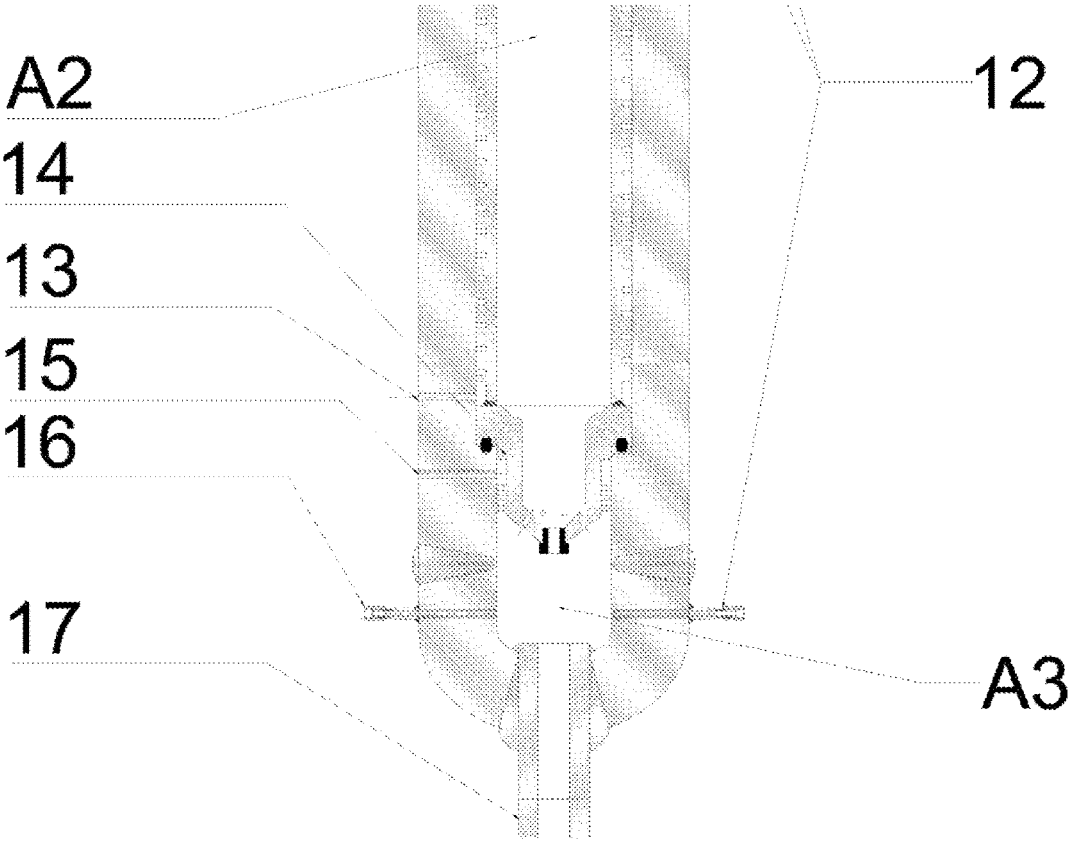
FIG. 3 is a partial (lower) enlarged view of Embodiment 1 of the invention.
Figure 4:
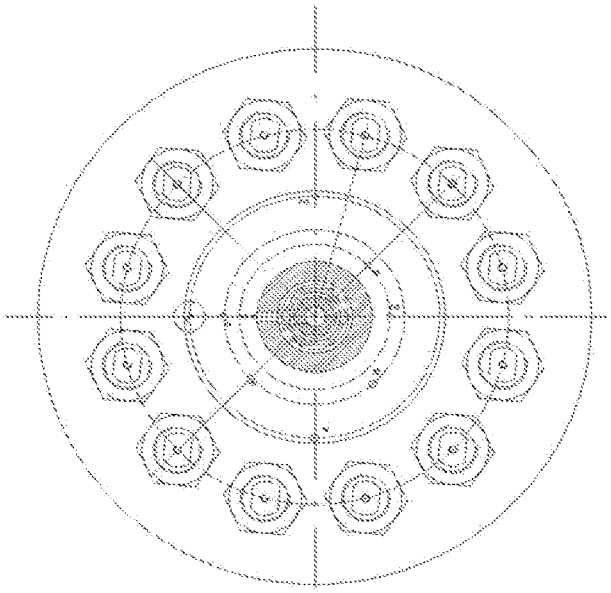
FIG. 4 is a top view of Embodiment 1 of the invention.
Figure 5:
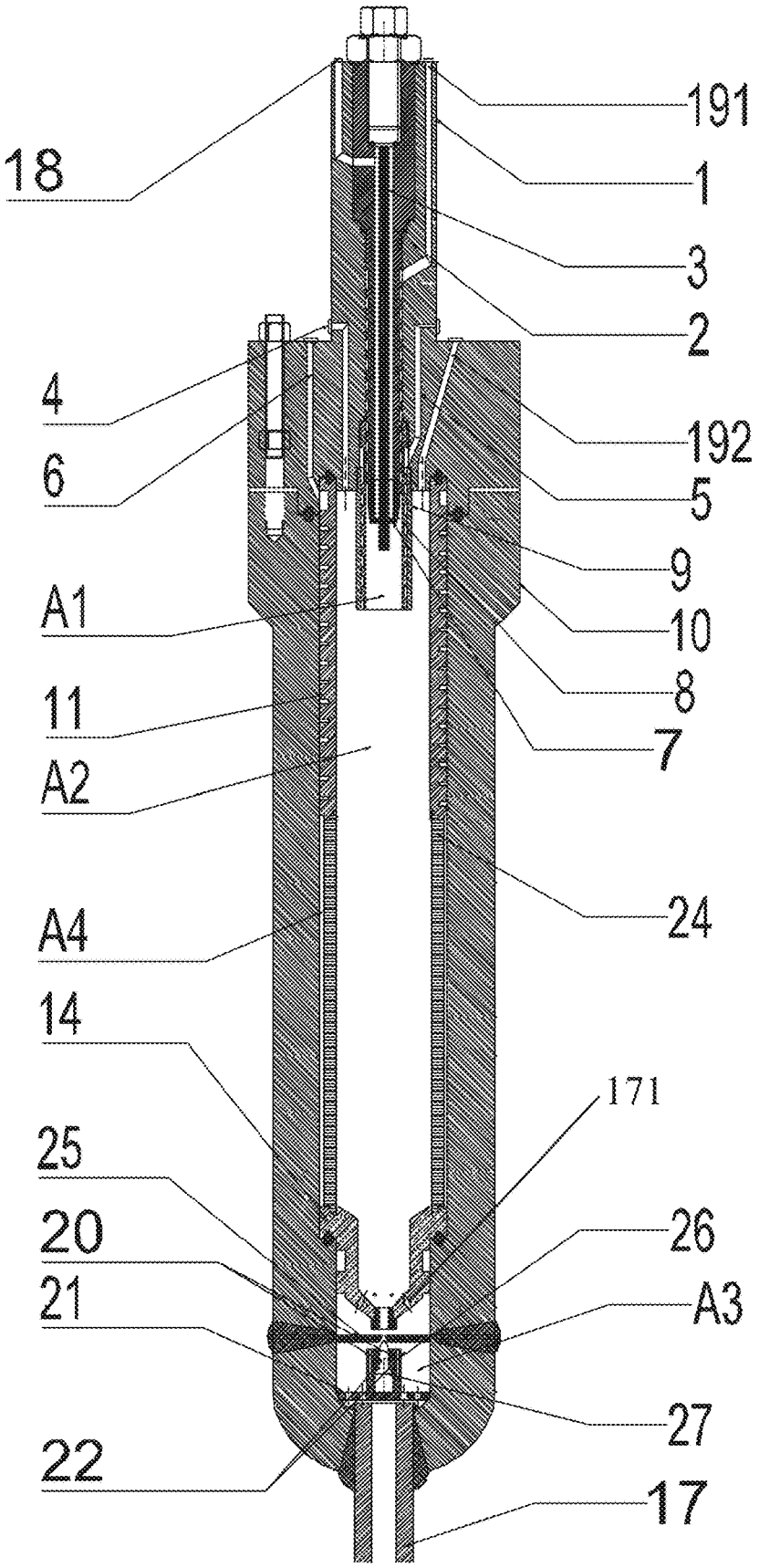
FIG. 5 is a structural view of Embodiment 2 of the invention.
Figure 6:
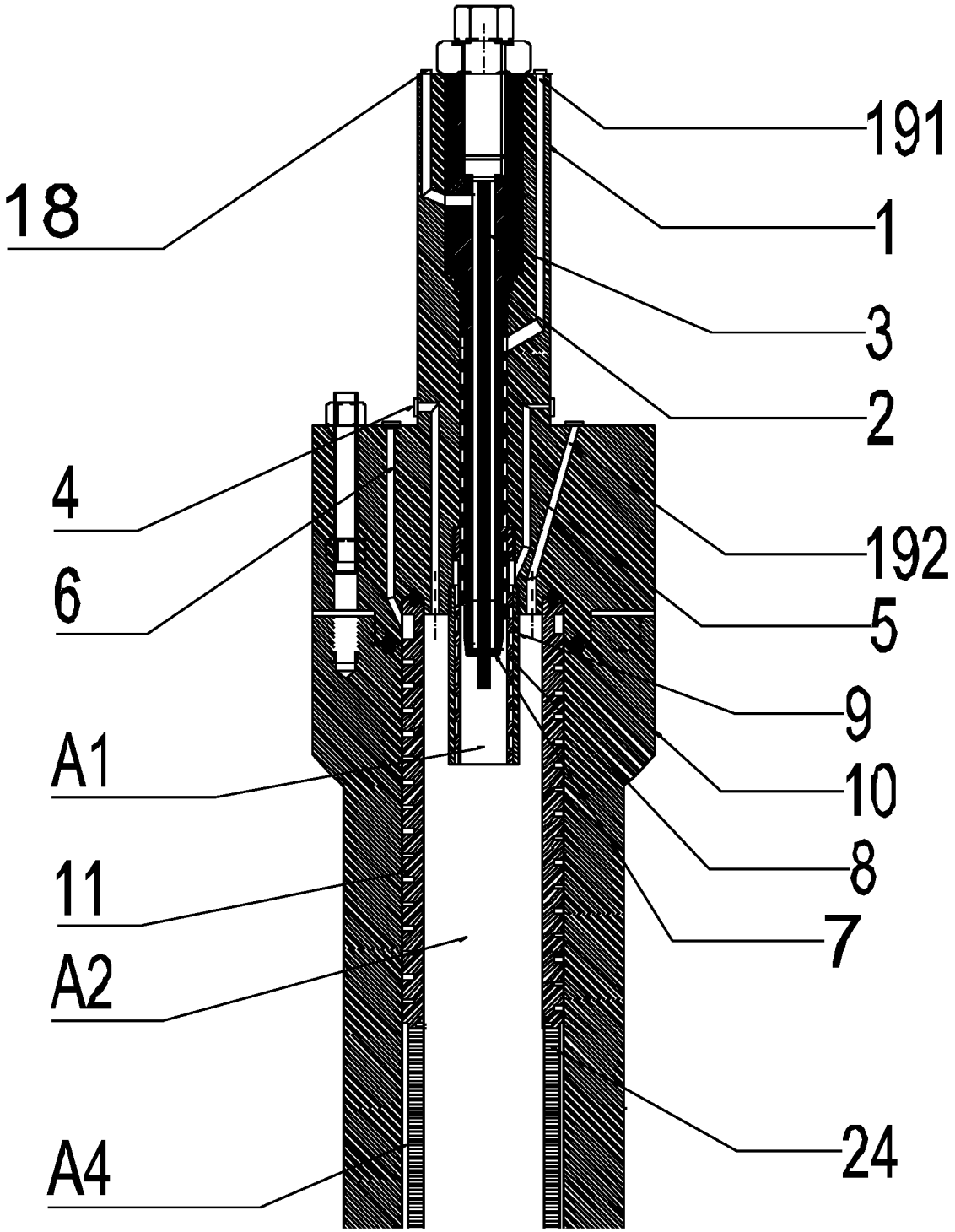
FIG. 6 is a partial (upper) enlarged view of Embodiment 2 of the invention.
Figure 7:
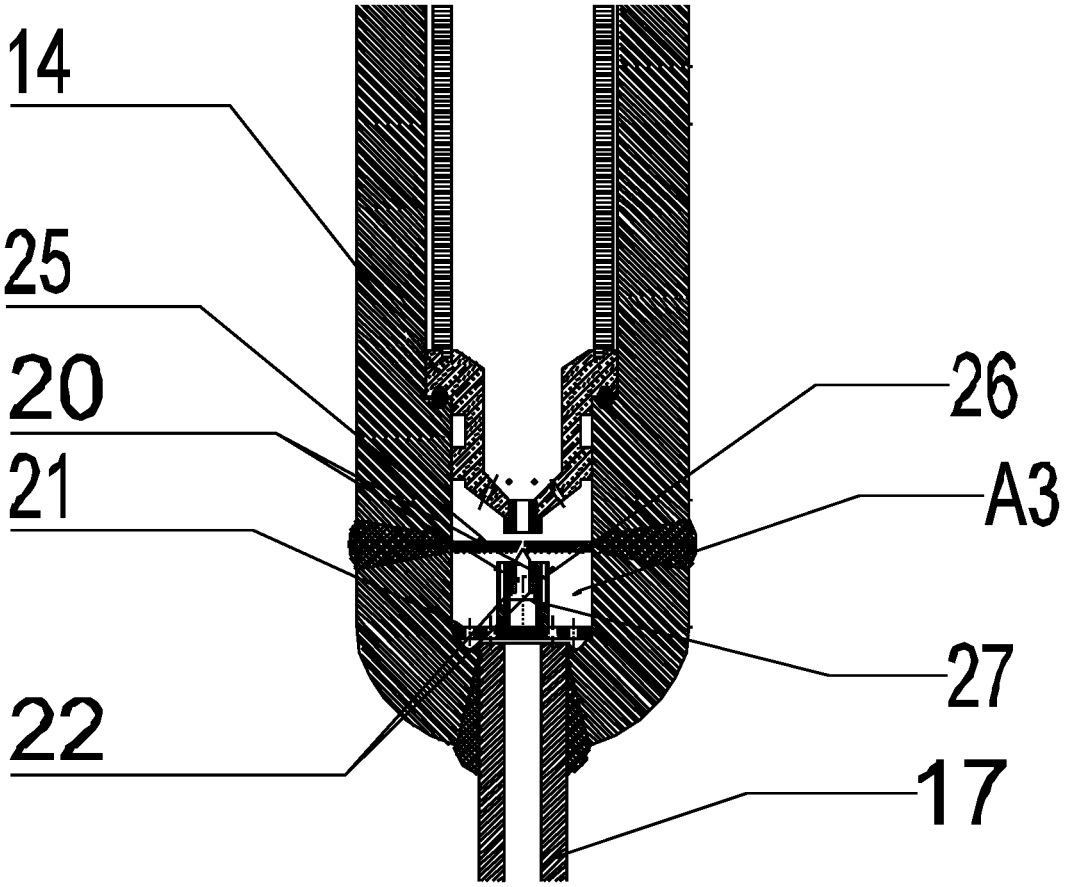
FIG. 7 is a partial (lower) enlarged view of Embodiment 2 of the invention.

The implementations of the invention will be described in detail below in conjunction with the drawings and embodiments.

Embodiment 1

As shown in FIG. 1, FIG. 2, FIG. 3 and FIG. 4, this embodiment provides a supercritical hydrothermal combustion device, comprising a main enclosure 10, wherein a top cap 1 is disposed at the top of the main enclosure 10.

In a practicable structure, the main enclosure 10 is cylindrical. Those skilled in the art would appreciate that the main enclosure 10 is not limited to the cylindrical shape and may be also be in other industrially available shapes.

In a practicable structure, the top cap 1 is mounted on the main enclosure 10 through a group of bolts, and a high-temperature seal ring is disposed at a contact surface of the top cap 1 and the main enclosure 10.

In this embodiment, a partition 14 is mounted in the main enclosure 10 and divides the interior of the main enclosure 10 into an upper main combustion space A2 and a lower mixing space A3. Wherein, a hole is formed in the partition 14 to communicate the main combustion space A2 with the mixing space A3, a mixing water inlet 15 is formed in an upper portion of the mixing space A3, mixing water and a combustion product generated in the main combustion space A2 are mixed in the mixing space A3, a combustion product nozzle 17 is disposed at the bottom of the mixing space A3, and the combustion product nozzle 17 acts as a final product outlet of the whole combustion device.

In a practicable structure, the bottom of the partition 14 is shaped like an inverted cone, so that a necking structure is formed; and an outlet nozzle is disposed at the center of the partition 14, and multiple small slant holes, acting as outlets, are formed in a conical surface of the partition 14, so that a first-stage pressure control structure is formed.

In a practicable structure, the cross-section of an inlet end of the combustion product nozzle 17 is smaller than that of the mixing space A3, and an outlet end of the combustion product nozzle 17 is provided with small holes acting as outlets, and a nozzle, so that a second-stage pressure control structure is formed.

In a practicable structure, a mixing channel is disposed on an outer wall of the partition 14, the mixing water inlet 15 is communicated with the mixing channel, and an outlet of the mixing channel faces the mixing space A3 to spirally spray mixing water into the mixing space A3.

In a practicable structure, a main enclosure water-cooled wall 11 is mounted in the main enclosure 10, the main enclosure water-cooled wall 11 only surrounds the main combustion space A2, a cooling water channel is formed between an outer surface of the main enclosure water-cooled wall 11 and an inner wall of the main enclosure 10, and the cooling water channel is provided with a main enclosure water-cooled wall inlet 6 and a main enclosure water-cooled wall outlet 13 located below the main enclosure water-cooled wall inlet 6. Practicably, the main enclosure water-cooled wall inlet 6 is formed in the top cap 1, and the main enclosure water-cooled wall outlet 13 is formed in a lower portion of the main enclosure 10.

In this embodiment, the top cap 1 is provided with a primary fuel inlet 18, an oxidant inlet 19 and a secondary fuel inlet 4, a high-temperature ignition bar sleeve 2 is disposed in the top cap 1, a high-temperature ignition bar 3 is disposed in the high-temperature ignition bar sleeve 2, the primary fuel inlet 18 is communicated with the interior of the high-temperature ignition bar sleeve 2, and the secondary fuel inlet 4 and a secondary oxidant inlet 192 are directly communicated with the main combustion space A2.

In a practicable structure, an oxidant channel is disposed on an outer wall of the high-temperature ignition bar sleeve 2 in a circumferential direction, and the oxidant inlet 19 is communicated with a stable combustion space A1 through the oxidant channel.

In this embodiment, a combustion sleeve 9 is mounted at the bottom of the top cap 1, a high-temperature end of the high-temperature ignition bar 3 stretches into the combustion sleeve 9, the top of the combustion sleeve 9 is communicated with the high-temperature ignition bar sleeve 2 and the oxidant inlet 19, the bottom of the combustion sleeve 9 is communicated with the main combustion space A2, and the stable combustion space A1 is formed in the combustion sleeve 9.

In a practicable structure, a primary fuel nozzle 7 is mounted at the bottom of the high-temperature ignition bar sleeve 2, and a primary fuel enters the primary fuel nozzle 7 along an annular space formed between the high-temperature ignition bar 3 and the high-temperature ignition bar sleeve 2 and is sprayed into the stable combustion space A1.

In a practicable structure, the primary fuel nozzle 7 is a replaceable nozzle and is coaxial with the high-temperature ignition bar 3 to form an annular gap, small holes 71 tilting by a certain angle, including but not limited to 30°, 45°, 60° and 90°, are formed in the primary fuel nozzle 7 in a circumferential direction, a coaxial gap is formed between the primary fuel nozzle 7 and the high-temperature ignition bar 3, and the primary fuel is sprayed into the stable combustion space A1 obliquely and vertically to be fully mixed with an oxidant.

In a practicable structure, a vortex wall 8 is mounted in the combustion sleeve 9, a vortex wall cooling water channel is formed between an outer surface of the vortex wall 8 and an inner wall of the combustion sleeve 9, a vortex wall cooling water inlet 5 of the vortex wall cooling water channel is located in the top cap 1, and a vortex wall cooling water outlet of the vortex wall cooling water channel faces the main combustion space A2, so that heated cooling water is spirally sprayed into the main combustion space A2 to be mixed with and transfer heat to a secondary fuel and a secondary oxidant.

In a practicable structure, the high-temperature ignition bar 3, the high-temperature ignition bar sleeve 2, the primary fuel nozzle 7, a vortex wall 8 and the combustion sleeve 9 are assembled coaxially and penetrate through the top cap 1. The top cap 1, the combustion sleeve 9, the vortex wall 8, the main enclosure 10, the main enclosure water-cooled wall 11, the partition 14 and the combustion product nozzle 17 are connected and assembled in turn to form the whole combustion device.

In a practicable structure, the flow rate of the primary fuel inlet 18 is far small than that of the secondary fuel inlet 4, and the primary fuel under a small flow rate is fully mixed with the oxidant in the stable combustion space A1, and is stably ignited when contacting the high-temperature front end of the high-temperature ignition bar in the stable combustion space A1. The stable combustion space A1 is inserted into the upper portion of the main combustion space A2 by a certain length, and a high-temperature combustion product and non-combusted high-temperature oxidant in the stable combustion space A1 are rapidly sprayed into the main combustion space A2 to be turbulently mixed with a secondary fuel and a secondary oxidant under a large flow rate and a cold state to induce intense heat transfer, so the secondary fuel and the secondary oxidant are quickly heated to spontaneous ignition temperature, thermal spontaneous ignition of the materials under a large flow rate and a cold state is realized, and a stable hydrothermal flame is generated.

In a practicable structure, a temperature sensor 12 and a pressure sensor 16 are disposed on the main enclosure 10.

In a practicable structure, the oxidant channel, the cooling water channel and the mixing water channel are all spiral channels.

In this embodiment, the supercritical hydrothermal combustion device contains vertex wall cooling water, main enclosure cooling water and mixing water, wherein the vortex wall cooling water and the main enclosure cooling water absorb heat generated by combustion, so that the wall surface is prevented from being overheated; and the final temperature of the combustion product is adjusted by the mixing water to ensure that the combustion product meets parameter requirements.

In this embodiment, pressure control structures, namely the necking structure at the bottom of the partition 14 and the combustion product nozzle 17, are disposed in the supercritical hydrothermal combustion device, the combustion product is sprayed into the mixing space A3 via a small-diameter outlet nozzle and multiple small slant outlets 171 acting as outlets; and after being mixed in the mixing space A3, the combustion product is sprayed out via the small-diameter combustion product nozzle 17, ensuring that the pressure of the combustion product is within a designed range.

According to the above structural description, the supercritical hydrothermal combustion device in this embodiment is started as follows: the high-temperature ignition bar 3 is started first to ignite a primary fuel under a small flow rate and a cold state entering the device via the primary fuel inlet 18 and an oxidant entering the device via the oxidant inlet 19; vortex wall cooling water flows into the vortex wall 8, absorbs heat of a hydrothermal flame in the stable combustion space A1, and is then spirally sprayed into the main combustion space A2 to be intensely mixed with and transfer heat to a secondary fuel; the secondary fuel under a large flow rate and a cold state is turbulently mixed with a high-temperature combustion product and a non-combusted high-temperature oxidant to transfer heat intensely and rapidly rises to spontaneous ignition temperature, so that thermal spontaneous ignition of the materials under a large flow rate and a cold state is realized, and a stable hydrothermal flame is generated; cooling water flows in via the main enclosure water-cooled water inlet 6 and absorbs heat of the combustion product in the main combustion space A2, so that the wall surface of the device is prevented from being overheated, and safe and reliable operation of the device is guaranteed; the combustion product in the main combustion space A2 is sprayed into the mixing space via the small slant holes and the small-diameter nozzle on the partition 14, and is mixed with heated mixing water entering the spiral space above the partition 14 via the mixing water inlet 15 to obtain a combustion product with target parameters, and the combustion product is sprayed out via the combustion product nozzle 17; and the temperature and pressure of the device in the whole operating process are monitored by the temperature sensor 13 and the pressure sensor 17, which are linked with key devices in the system, so that the device can be stopped automatically in case of excessive temperature or pressure.

According to the supercritical hydrothermal combustion device provided by this embodiment, materials can be fed in a cold state to stably generate a hydrothermal flame, operation is safe and reliable, heat generated by hydrothermal combustion can be used to the maximum extent, and a high-efficiency, energy-saving and safe device is provided for organic waste treatment of supercritical hydrothermal combustion and thermal recovery of heavy oil.

Embodiment 2

Referring to FIG. 5, FIG. 6, FIG. 7 and FIG. 8, on the basis of Embodiment 1, this embodiment is further improved in one or more of the following aspects:

1. The main enclosure water-cooled wall 11 is disposed merely on an upper portion of the inner wall of the main enclosure 10, a transpiring wall 24 is disposed on a lower portion of the inner wall of the main enclosure 10, and a transpiring wall space A4 is formed between the transpiring wall 24 and the main enclosure 10; wall cooling water enters the cooling water channel between the main enclosure water-cooled wall 11 and the main enclosure 10 via the main enclosure water-cooled wall inlet 6 and absorbs combustion heat in the main combustion space A2 to prevent the wall temperature from being too high; then, the wall cooling water flows into the transpiring wall space A4 in an axial direction, forms a liquid membrane on the surface of the transpiring wall 24, and is directly mixed with a hybrid thermal fluid in the lower portion of the main combustion space A2, so that inorganic salts separated out of supercritical water are prevented from being deposited on the wall surface, which may otherwise cause corrosion. In addition, the mixing water inlet is not needed anymore, and the liquid membrane obtained by transpiring is directly used for mixing. The supercritical hydrothermal combustion device in this embodiment can prevent salt-deposition and corrosion, so oily wastewater of oilfields can be directly combusted to be used as a primary fuel and a secondary fuel, reducing operating costs. Illustratively, the transpiring wall 24 is composed of a porous pipe and is engaged and connected with the main enclosure water-cooled wall 11 in the axial direction. A bottom edge of the transpiring wall 24 may be engaged and connected with a top edge of the partition 14.
2. The oxidant inlet 19 is divided into a primary oxidant inlet 191 and a secondary oxidant inlet 192, the primary oxidant inlet 191 is communicated with the oxidant channel, and the secondary oxidant inlet 192 is directly communicated with the main combustion space A2.

The flow rate of the primary fuel inlet 18 is far smaller than that of the secondary fuel inlet 4, and the flow rate of the primary oxidant inlet 191 may be smaller than that of the secondary oxidant inlet 192. A primary fuel and a primary oxidant under a small flow rate contact the high-temperature front end of the high-temperature ignition bar 3 in the stable combustion space A1 to be stably ignited, and the high-temperature ignition bar 3 may be replaced with a heating bar.

Figure 8:
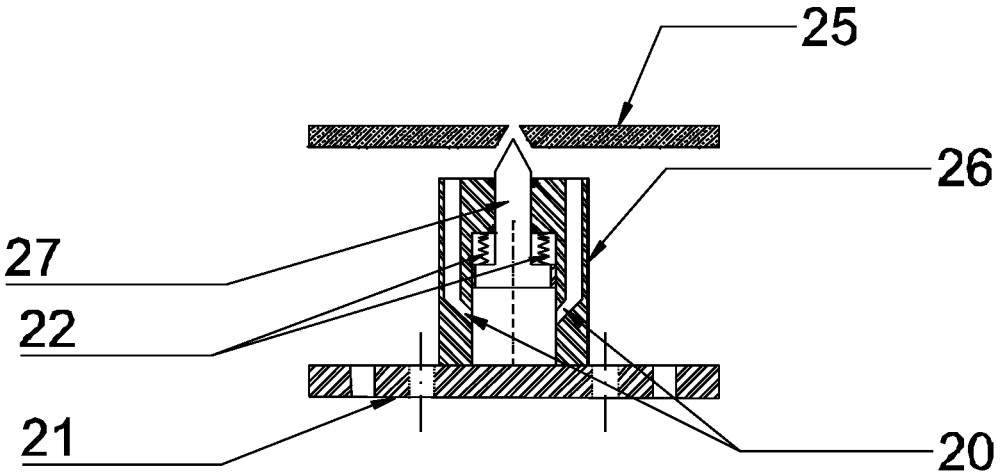
FIG. 8 is an enlarged view of a pressure auto-regulation device.

3. A pressure auto-regulation device, shown in FIG. 8, is additionally disposed in the main enclosure 10 and is located at an inlet end of the combustion product nozzle 17, so the pressure of products can be regulated automatically through a mechanical structure without extra energy such as electricity; the pressure auto-regulation device comprises a pressure regulation plate 25 provided with a first hole and a pressure regulation device base plate 21 provided with a second hole, the pressure regulation plate 25 and the pressure regulation device base plate 21 are both mounted on the inner wall of the main enclosure 10, the pressure regulation plate 25 is located above the pressure regulation device base plate 21, a pressure regulation device shell 26 is mounted on the pressure regulation device base plate 21, a pressure regulation rod 27 capable of moving in an axial direction is mounted in the pressure regulation device shell 26 through axial pressure regulation springs 22, and the pressure regulation rod 27 stretches upward out of the pressure regulation device shell 26 and is opposite to the first hole.

Further, the pressure regulation rod 27 is of an inverted-T structure, upper surfaces of two arms of the pressure regulation rod 27 are connected to a lower surface of a top wall of the pressure regulation device shell 26 through the pressure regulation springs 22, and an intermediate rod stretches upward out of the pressure regulation device shell 26 and is opposite to the first hole.

Further, a plurality of pressure guide holes 20 are formed in a top surface of the pressure regulation device shell 26 and are communicated with the interior of the pressure regulation device shell 26.

Further, a front end of the pressure regulation rod 27 is shaped like a cone, and the first hole matches the cone in shape.

The principle of the pressure auto-regulation device is as follows: a hybrid thermal fluid is throttled to a small target pressure through a gap between the pressure regulation plate 25 and the pressure regulation rod 27. A small part of the throttled hybrid thermal fluid flows into the pressure guide holes 20 in the pressure regulation device shell 26 and is counterbalanced with the reactive force of the pressure regulation springs 22. When the pressure of the hybrid thermal fluid increases, the hybrid thermal fluid pushes the pressure regulation rod 27 to move towards the pressure regulation plate 25, the gap between the pressure regulation rod 27 and the pressure regulation plate 25 becomes smaller, the fluid resistance increases, and the hybrid thermal fluid restores to a target pressure; when the pressure of the hybrid thermal fluid becomes lower by throttling, the process is opposite to the above process, the fluid resistance decreases, and the hybrid thermal fluid restores to the target pressure. Finally, the hybrid thermal fluid is sprayed out via the combustion product nozzle 17.

According to the above structural description, the supercritical hydrothermal combustion device in this embodiment is started as follows:

The high-temperature ignition bar 3 is started first to ignite a primary fuel in a cold state entering the device via the primary fuel inlet 18 and a primary oxidant entering the device via the primary oxidant inlet 191, and the flow rate of the primary fuel and the flow rate of the primary oxidant are small at this moment. Vortex wall cooling water flows into the vortex wall 8 and absorbs the heat of a hydrothermal flame in the stable combustion space A1. A secondary fuel and a secondary oxidant under a large flow rate and a cold state are turbulently mixed with a high-temperature combustion product of the primary fuel and the primary oxidant to induce intense heat transfer and are quickly heated to spontaneous ignition temperature, so that thermal spontaneous ignition of the materials under a large flow rate and a cold state is realized, and a stable hydrothermal flame is generated. Wall cooling water flows in via the main enclosure water-cooled wall inlet 6 and absorbs heat of the combustion product in the main combustion space A2, so that the wall surface of the device is prevented from being overheated; then, the wall cooling water flows into the transpiring wall space A4 in the axial direction, forms a liquid membrane on the surface of the transpiring wall 24, and is directly mixed with a hybrid thermal fluid in the lower portion of the main combustion space A2, so that inorganic salts separated out of supercritical water are prevented from being deposited on the wall surface, which may otherwise cause corrosion. The hybrid thermal fluid is sprayed out via the small slant holes and the small-diameter nozzle on the partition 14, and is throttled to a small target pressure through a gap between the pressure regulation plate 25 and the pressure regulation rod 27. A small part of the throttled hybrid thermal fluid flows into the pressure guide holes 20 in the pressure regulation device shell 26 and is counterbalanced with the reactive force of the pressure regulation springs 22. When the pressure of the hybrid thermal fluid increases, the hybrid thermal fluid pushes the pressure regulation rod 27 to move towards the pressure regulation plate 25, the gap between the pressure regulation rod 27 and the pressure regulation plate 25 becomes smaller, the fluid resistance increases, and the hybrid thermal fluid restores to a target pressure; when the pressure of the hybrid thermal fluid becomes lower by throttling, the process is opposite to the above process, the fluid resistance decreases, and the hybrid thermal fluid restores to the target pressure. Auto-regulation of the pressure of products is realized. The hybrid thermal fluid flow into the combustion product nozzle 17 via the second hole in the pressure regulation device base plate 21 and is then sprayed out.

In this embodiment, combustion energy can be fully used through the hydrothermal combustion technology, a hybrid thermal fluid is generated directly in the stratum, and efficient recovery of heavy oil is realized. The transpiring wall and the water-cooled wall in the reactor can effectively prevent salt-deposition and corrosion, and auto-regulation of pressure changes of products is realized through the pressure auto-regulation device, so that the pressure of the hybrid thermal fluid is kept constant.

To sum up, this embodiment provides a supercritical hydrothermal combustion-based underground hybrid thermal fluid generator capable of realizing auto-regulation of the pressure of products, oily wastewater in oilfields can be fed in a cold state to stably generate a hydrothermal flame, salt-deposition and corrosion are avoided, auto-regulation of the pressure of products can be realized without extra energy such as electricity, the operation cost is low, operation is safe and reliable, heat generated by hydrothermal combustion is used to the maximum extent, and a safe and high-efficiency hybrid thermal fluid generator is provided for thermal recovery of heavy oil.

What is claimed is:

1. A supercritical hydrothermal combustion device, comprising a main enclosure (10), a top cap (1) being mounted at a top of the main enclosure (10), wherein:

a partition (14) is mounted in the main enclosure (10) and divides an interior of the main enclosure (10) into an upper main combustion space A2 and a lower mixing space A3, a hole is formed in the partition (14), a mixing water inlet (15) is formed in an upper portion of the mixing space A3, and a combustion product nozzle (17) is disposed at a bottom of the mixing space A3;

the top cap (1) is provided with a primary fuel inlet (18), an oxidant inlet (19) and a secondary fuel inlet (4), a high-temperature ignition bar sleeve (2) is disposed in the top cap (1), a high-temperature ignition bar (3) is disposed in the high-temperature ignition bar sleeve (2), and the primary fuel inlet (18) is communicated with an interior of the high-temperature ignition bar sleeve (2);

a combustion sleeve (9) is mounted at a bottom of the top cap (1), a high-temperature end of the high-temperature ignition bar (3) extends into the combustion sleeve (9), the combustion sleeve (9) has a top communicated with the high-temperature ignition bar sleeve (2) and the oxidant inlet (19), as well as a bottom communicated with the main combustion space A2, and a stable combustion space A1 is formed in the combustion sleeve (9), thereby a primary fuel and oxidant provided into the stable combustion space A1 is in direct contact with the high-temperature ignition bar (3) in the stable combustion space A1;

the secondary fuel inlet (4) is directly communicated with the main combustion space A2.

2. The supercritical hydrothermal combustion device according to claim 1, wherein an oxidant channel is disposed on an outer wall of the high-temperature ignition bar sleeve (2) in a circumferential direction, and the oxidant inlet (19) is communicated with the stable combustion space A1 through the oxidant channel.

3. The supercritical hydrothermal combustion device according to claim 1, wherein the oxidant inlet (19) comprises a primary oxidant inlet (191) and a secondary oxidant inlet (192), the primary oxidant inlet (191) is communicated with the oxidant channel, and the secondary oxidant inlet (192) is directly communicated with the main combustion space A2.

4. The supercritical hydrothermal combustion device according to claim 3, wherein a flow rate of the primary fuel inlet (18) is fax smaller than that of the secondary fuel inlet (4) such that forced ignition occurs first in the stable combustion space A1 and intense heat transfer occurs in the main combustion space A2.

5. The supercritical hydrothermal combustion device according to claim 1, wherein a portion, located in the stable combustion space A1, of the high-temperature ignition bar (3) is at high temperature to realize forced ignition of a primary fuel and oxidant in the stable combustion space A1, and the stable combustion space A1 is inserted into an upper portion of the main combustion space A2, so that a high-temperature combustion product and non-combusted high-temperature oxidant in the stable combustion space A1 are rapidly injected into the main combustion space A2 to be turbulently mixed with a secondary fuel under a flow rate and a cold state to induce intense heat transfer rapidly heat the secondary fuel to spontaneous ignition temperature, thermal spontaneous ignition of material in the cold state, and a stable hydrothermal flame is generated.

6. The supercritical hydrothermal combustion device according to claim 1, wherein a primary fuel nozzle (7) is mounted at a bottom of the high-temperature ignition bar sleeve (2) and is communicated with an annular space formed between the high-temperature ignition bar (3) and the high-temperature ignition bar sleeve (2), and a primary fuel enters the primary fuel nozzle (7) along the annular space formed between the high-temperature ignition bar (3) and the high-temperature ignition bar sleeve (2) and is sprayed into the stable combustion space A1.

7. The supercritical hydrothermal combustion device according to claim 6, wherein the primary fuel nozzle (7) is a replaceable nozzle, and is coaxial with the high-temperature ignition bar (3) to form an annular gap, small slant holes (71) are formed in the primary fuel nozzle (7) in a circumferential direction, and the primary fuel is sprayed into the stable combustion space A1 obliquely and vertically to be mixed with an oxidant.

8. The supercritical hydrothermal combustion device according to claim 6, wherein a vortex wall (8) is mounted in the combustion sleeve (9), a vortex wall cooling water channel is formed between an outer surface of the vortex wall (8) and an inner wall of the combustion sleeve (9), a vortex wall cooling water inlet (5) of the vortex wall cooling water channel is located in the top cap (1), and a vortex wall cooling water outlet of the vortex wall cooling water channel faces the main combustion space A2, so that heated cooling water is spirally sprayed into the main combustion space A2 and is mixed with and transfers heat to a secondary fuel.

9. The supercritical hydrothermal combustion device according to claim 8, wherein the high-temperature ignition bar (3), the high-temperature ignition bar sleeve (2), the primary fuel nozzle (7), the vortex wall (8) and the combustion sleeve (9) are assembled coaxially and penetrate through the top cap (1).

10. The supercritical hydrothermal combustion device according to claim 1, wherein a main enclosure water-cooled wall (11) is mounted in the main enclosure (10) corresponding to the main combustion space A2, a cooling water channel is formed between an outer surface of the main enclosure water-cooled wall (11) and an inner wall of the main enclosure (10), a main enclosure water-cooled wall inlet (6) of the cooling water channel is located in the top cap (1), and a main enclosure water-cooled wall outlet (13) is located below the main enclosure (10).

11. The supercritical hydrothermal combustion device according to claim 10, wherein the main enclosure water-cooled wall (11) is disposed on an upper portion of the inner wall of the main enclosure (10), a transpiring wall (24) is disposed on a lower portion of the inner wall of the main enclosure (10), and a transpiring wall space A4 is formed between the transpiring wall (24) and the main enclosure (10); and wall cooling water enters the cooling water channel between the main enclosure water-cooled wall (11) and the main enclosure (10) via the main enclosure water-cooled wall inlet (6) and absorbs combustion heat in the main combustion space A2; and then, the wall cooling water flows into the transpiring space A4 in an axial direction and forms a liquid membrane on a surface of the transpiring wall (24) to be mixed with a hybrid thermal fluid.

12. The supercritical hydrothermal combustion device according to claim 11, wherein the liquid membrane is mixed with the hybrid thermal fluid to directly obtain a product which is then discharged.

13. The supercritical hydrothermal combustion device according to claim 11, wherein the transpiring wall (24) is composed of a porous pipe, and is engaged and connected with the main enclosure water-cooled wall (11) in the axial direction.

14. The supercritical hydrothermal combustion device according to claim 11, wherein a bottom edge of the transpiring wall (24) is engaged and connected with a top edge of the partition (14).

15. The supercritical hydrothermal combustion device according to claim 1, wherein a bottom of the partition (14) is shaped like an inverted cone to form a necking structure, an outlet nozzle is disposed at a center of the partition (14), multiple small slant holes, acting as outlets, are formed in a conical surface, and a cross-section of an inlet end of the combustion product nozzle (17) is smaller than that of the mixing space A3, and an outlet end of the combustion product nozzle (17) is provided with small holes (171) acting as outlets, and a nozzle, so that dual pressure control is realized.

16. The supercritical hydrothermal combustion device according to claim 1, wherein a mixing channel is disposed on an outer wall of the partition (14), and the mixing water inlet (15) is communicated with the mixing channel.

17. The supercritical hydrothermal combustion device according to claim 1, wherein a pressure auto-regulation device is disposed in the main enclosure (10) and is located at the inlet end of the combustion product nozzle (17), the pressure auto-regulation device comprises a pressure regulation plate (25) provided with a first hole and a pressure regulation device base plate (21) provided with a second hole, the pressure regulation plate (25) and the pressure regulation device base plate (21) are mounted on an inner wall of the main enclosure (10), the pressure regulation plate (25) is located above the pressure regulation device base plate (21), a pressure regulation device shell (26) is mounted on the pressure regulation device base plate (21), a pressure regulation rod (27) capable of moving in an axial direction is mounted in the pressure regulation device shell (26) through axial pressure regulation springs (22), and the pressure regulation rod (27) stretches upward out of the pressure regulation device shell (26) and is opposite to the first hole.

18. The supercritical hydrothermal combustion device according to claim 17, wherein the pressure regulation rod (27) is of an inverted-T structure, upper surfaces of two arms of the pressure regulation rod (27) are connected to a lower surface of a top wall of the pressure regulation device shell (26) through the pressure regulation springs (22), and an intermediate rod stretches upward out of the pressure regulation device shell (26) and is opposite to the first hole.

19. The supercritical hydrothermal combustion device according to claim 17, wherein a plurality of pressure guide holes (20) are formed in a top surface of the pressure regulation device shell (26) and are communicated with an interior of the pressure regulation device shell (26).

20. The supercritical hydrothermal combustion device according to claim 17, wherein a front end of the pressure regulation rod (27) is shaped like a cone, and the first hole matches the cone in shape.

* * * * *